United States Patent [19]

Rua, Jr. et al.

[11] Patent Number: 5,000,486

[45] Date of Patent: Mar. 19, 1991

[54] FRAGRANCE ENHANCED SCRATCH-OFF LAYER FOR GAME CARDS

[75] Inventors: Louis Rua, Jr., Plainsboro; Carl Schaab, Princeton Junction, both of N.J.

[73] Assignee: 501 Webcraft Technologies, Inc., No. Brunswick, N.J.

[21] Appl. No.: 449,762

[22] Filed: Dec. 12, 1989

[51] Int. Cl.[5] ..... B42D 15/00

[52] U.S. Cl. ..... 283/102; 283/903; 428/204; 428/402.2; 428/905; 503/206

[58] Field of Search ..... 427/355; 283/102, 95, 283/117, 903, 901; 428/204, 905, 321.5, 402.2, 313.5; 503/206

[56] References Cited

U.S. PATENT DOCUMENTS

| | | | |
|---|---|---|---|
| Re. 33,299 | 8/1990 | Sweeny et al. | 428/204 X |
| 1,972,206 | 9/1934 | Thomay | 273/157 |
| 3,050,870 | 8/1962 | Heilig | 434/365 |
| 3,570,139 | 3/1971 | Ladd | 35/8 |
| 3,967,880 | 7/1976 | Johnson | 350/133 |
| 4,243,224 | 1/1981 | Spector | 273/157 R |
| 4,398,708 | 8/1983 | Goldman et al. | 283/102 X |
| 4,487,801 | 12/1984 | Turnbull et al. | 428/313.5 |
| 4,528,226 | 7/1985 | Sweeny | 428/40 |
| 4,528,492 | 4/1986 | Etter | 434/236 |
| 4,606,956 | 8/1986 | Charbonneau | 428/40 |
| 4,654,256 | 3/1987 | Doree et al. | 428/905 X |
| 4,687,203 | 8/1987 | Spector | 273/157 R |
| 4,720,417 | 1/1988 | Sweeny | 428/201 |
| 4,720,423 | 1/1988 | Fraser | 428/313.5 |
| 4,738,473 | 4/1988 | Meloni et al. | 283/903 |
| 4,778,153 | 10/1988 | Bachman et al. | 283/903 |
| 4,881,758 | 11/1989 | David | 283/102 |
| 4,935,401 | 6/1990 | Pendergrass, Jr. | 503/206 |

FOREIGN PATENT DOCUMENTS

| | | | |
|---|---|---|---|
| 768040 | 9/1967 | Canada | 283/903 |

*Primary Examiner*—Paul A. Bell

*Attorney, Agent, or Firm*—Shlesinger & Myers

[57] ABSTRACT

A scratch-off game piece which contains a fragrance which is released during the game play action. The game piece is constructed by application of layers of fragrance containing material and scratch-off material over a support layer of printed sheet material such that when the scratch-off material is removed by the player, the fragrance containing capsules are ruptured and fragrance is released.

8 Claims, 1 Drawing Sheet

FIG. 1
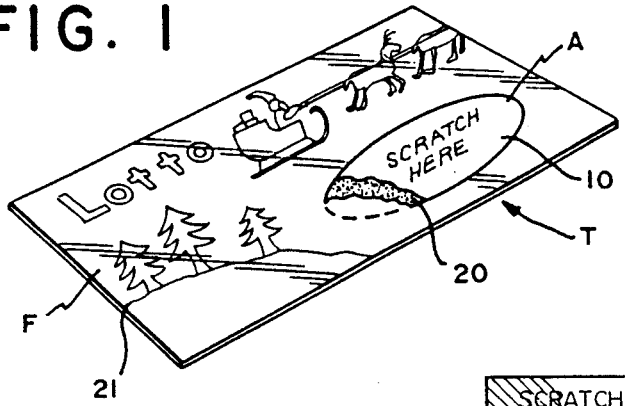
FIG. 2
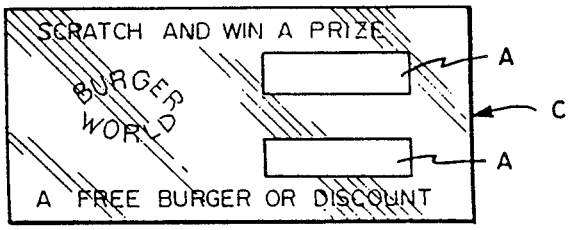
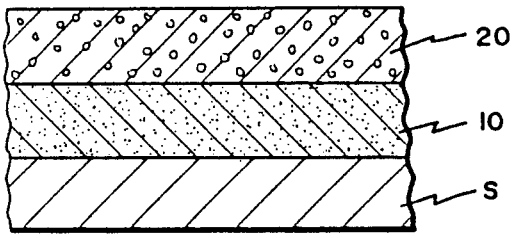
FIG. 3
FIG. 4
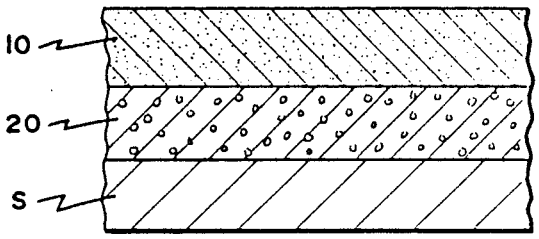
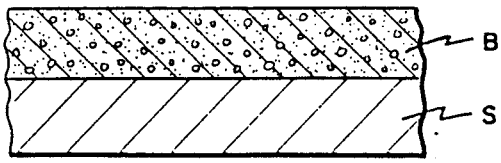
FIG. 5

FRAGRANCE ENHANCED SCRATCH-OFF LAYER FOR GAME CARDS

FIELD OF THE INVENTION

This invention relates to articles containing microencapsulated materials and methods of preparing such articles. In particular, the invention relates to lottery tickets or the like having microencapsulated materials applied to the surface of the support layer of printed sheet material along with a coating of scratch-off material. When the scratch-off material is removed by a player, the capsules rupture, releasing the fragrance contained therein.

BACKGROUND OF THE INVENTION

Encapsulated materials have been used for many years in a wide variety of commercial applications. Other uses of encapsulated materials included paper coated with capsules bearing coloring material therein which could be used as a recording medium. In addition to release of physically absorbable materials such as ink in order to form a visible image, other types of active ingredients such as odor releasing materials, and the like have been provided in this manner.

Items of this nature can increase consumer involvement in promoting products through advertisement. One of the most important things to do when doing business with consumers is to get their attention and interest in your products. With advertising promotions, the advertisement must hold the consumer's attention long enough for the consumer to be aware of the product being promoted. Because of this need to make the consumers stop and read the advertisement, companies place attention letters in advertisements to make people stop at the ad and notice the product promotion. One way of doing this is to place an advertisement which needs the consumer's participation to complete. This is known as consumer involvement.

One such type of consumer involvement item is the scratch-off game. This game can be anything which requires the consumer to stop and scratch off a covering from some part of the ad to reveal the prize or secret message. One type of scratch-off game that is very popular is the instant lottery ticket. This type of game benefits from the interest generated by consumer involvement as described above. Anything which can increase the consumer interest will increase sales of game tickets. Consumer interest can be increased by incorporating into scratch-off games a fragrance into the game piece. This can be done easily by using microencapsulated fragrances. These fragrances would be such that the scent would evoke a consumer response in accordance with the item being promoted or the content of the game. For example, the scent of Christmas trees would be incorporated into an instant lottery ticket which has a Christmas holiday theme. Another example would a cents off coupon by a coffee brand where the consumer had to scratch-off the area to determine the value of the coupon and this would release a coffee scent. The variations of game and scent combinations could be unlimited.

FEATURES AND SUMMARY OF THE INVENTION

One feature of the disclosed invention is a game piece having one or more layers of coatings thereon containing microscopic rupturable capsules containing fragrance covering a printed support substrate and a coating layer also covering the printed material to hide the printed matter until the coating layers have been scratched off and the microcapsules are ruptured.

Another feature of the disclosed invention is to apply a fragrance containing layer over a game piece and a scratch-off layer to the game piece without rupturing the fragrance containing layer.

Yet another feature of the disclosed invention is to provide a layer having both scratch-off material and fragrance containing microscopic rupturable capsules covering a portion of a support substrate of printed sheet material.

Another feature of the disclosed invention is to provide a method for applying coatings of fragrance containing microcapsules over a support substrate of printed sheet material and a coating layer of scratch-off material over the fragrance containing laYer without rupturing the microscopic rupturable capsules prior to use by the consumer.

In summary, therefore, this invention is directed to articles such as game pieces and coupons which stimulate both the olfactory and visual senses, and generate increased consumer interest in lottery tickets or coupons using scratch-off material to hide printed matter on a printed sheet and to emit a fragrance upon removal of the scratch-off layer. The article includes mixtures or layers of scratch-off material and microencapsulated fragrances adhered to a layer of sheet material.

These and other features and advantages of the invention will be readily apparent in view of the following description and drawings of the above described invention.

DESCRIPTION OF THE DRAWINGS

The above and other objects and advantages and novel features of the present invention will become apparent from the following detailed description of the preferred embodiment of the invention illustrated in the accompanying drawings, wherein:

FIG. 1 is a top plan view of a lottery ticket having fragrance enhancement in the scratch-off layer shown partially in section.

FIG. 2 is a top plan view of the invention being used in a coupon.

FIG. 3 is an enlarged fragmentary cross sectional view of the preferred embodiment of the invention having the microcapsule layer over the scratch-off layer.

FIG. 4 is an enlarged fragmentary cross sectional view of a second embodiment of the invention having the scratch-off layer over the microcapsule layer.

FIG. 5 is an enlarged fragmentary cross sectional view of the scratch-off layer blended with the microcapsule layer.

DESCRIPTION OF THE INVENTION

FIG. 1 shows a lottery ticket T having a typical lotto ticket format on the face F illustrating a scene corresponding to the type of scratch-off game or ad campaign used to increase sales of the tickets T. In the lottery ticket T there is always included a scratch-off area A covering the concealed prize or amount. FIG. 2 shows a typical coupon having scratch-off areas A covered by the scratch-off material, whereupon removing the scratch-off material reveals the hidden prize which may either be a free item or a discount such as cents off of your next purchase.

In each of the game card formats of FIGS. 1 and 2, fragrance has been added to scratch-off layer 10, thus adding a new dimension to the game. A fragrance-containing layer 20 is shown in FIGS. 1 and 4 located beneath the scratch-off layer 10.

Referring now to FIG. 3, the preferred embodiment of the invention is shown as having a support substrate S of paper, plastic or the like, coated by a layer of scratch-off material 10 which is in turn coated by a layer of fragrance-containing microcapsules 20.

The scratch-off material is a soft polymeric elastomer dissolved in solvent. To this is added a metallic particle for color and opacity with aluminum, brass or bronze being common. Also, inorganic fillers are used and these can include titanium dioxide, calcium carbonate or carbon. Various mixtures of elastomers, metals, and fillers can generate products with various properties such as ease of removal, opacity, and color. Systems that are aqueous rather than organic solvent based are commercially rare, but can be manufactured. The scratch-off material can be commercially purchased and its specific formulation is secret to those who manufacture these products.

Common methods of application of the scratch-off material are flexographic, gravure or silk screen printing techniques, but other techniques such as extrusion can be used. After the scratch-off is dried, the fragrance capsule slurry can be applied by some of the same printing or extrusion methods Over the scratch-off.

Capsules in the range of 5 to 150 microns are practical for use in the microcapsule layer. The capsules are preferably in the 10 to 70 micron range, with the 10 to 40 micron range being optimum. Microcapsules can be produced by any of the standard methods listed in the current literature.

When the scratch-off is removed by scratching to reveal the game area, the microcapsules are broken and the fragrance is released and can be olfactorily detected by the consumer.

Preferably, game cards have the scratch-off material as the last layer over the game play area. Lottery tickets or other complex, high security or decorative games have additional printing on top of the scratch-off material. It is most advantageous to put the microcapsules as the top most layer of this construction so that the additional printing does not damage the capsules.

When as in the preferred embodiment, the fragrance is applied over the scratch-off material, the formulation for the fragrance coating would include about 10–30 percent capsules, 1–20 percent binder, 0–10 percent thickener-reology agent and 50–88 percent water.

A different construction as shown in FIG. 4 using the same application techniques would be to put the fragrance capsules 20 down first and dry this layer before applying the scratch-off material 10. In the multi-layer lottery ticket, the capsules can be placed beneath the scratch-off, or above the scratch-off, but below any of the subsequent layers. If multiple layers of scratch-off are used, the capsules can be placed between any layer. The problem with this arrangement of layers is that any layer placed over the capsules must be done with extreme care so that the capsules are not broken during manufacturing allowing release of the fragrance prematurely.

The formulation for the fragrance containing layer when applied prior to application of the scratch-off layer would include 10–30 percent capsules, 1–20 percent binder, 0–10 percent thickener-reology agent and 50–88 percent water.

FIG. 5 illustrates another construction which includes blending of the microcapsules directly into the scratch-off material and applying the microcapsules and scratch-off materials as a blend B over the support layer of printed sheet material S simultaneously. There are three methods by which this product could be prepared.

First, the microcapsules are normally prepared as a water suspension. The technique is known to evaporate the water and produce residual capsules which are a dry free flowing powder. This dry powder can then be blended into the solvent based scratch-off material and would act as an additional filler. The blended materials could then be applied to the sheet material by any standard techniques for applying scratch-off materials, such as flexographic, gravure, or silk screen printing or extrusion. The problem with this method is that losses of microcapsules are high and microcapsules are fairly expensive to obtain.

The second method is to incorporate the microcapsule slurry directly into the scratch-off. Since the microcapsule slurry is normally water based, it would be necessary to use a water based scratch-off material. Although not as common as solvent based systems, aqueous scratch-offs can be made. Since both the scratch-off and the microcapsules are now aqueous, they can be blended with little problem. The scratch-off could be made with less water than normal or some of the water could be removed from the fragrance capsule slurry by filtration, if necessary, to prevent over-dilution of the mixture. Once blended, the mixture can be applied by the methods described above.

A third technique for incorporating microcapsules into the organic solvent based scratch-off material is to convert the aqueous microcapsule solution to an organic solvent base solution. Taking the aqueous microcapsule slurry and adding thereto a dehydrating agent, the slurry solution can be transformed into an organically soluable solution. Selecting an appropriate dehydrating agent is of paramount importance. Some alcohols will penetrate without destroying the microcapsule and leach out the fragrance. Other dehydrating agents will destroy the capsule wall. Hexylene glycol has been found to dewater capsules in aqueous solutions without detrimentally affecting the yield of capsules from the solution. By repeatedly adding hexylene glycol and decanting, the aqueous microcapsule solution can be effectively dehydrated. Adding an additional non-ionic solvent such as naptha or toluene to the hexylene glycol and microcapsule solution creates a solution which is more mixable with the scratch-off material which is usually naptha-solvent based. Before mixing the dehydrated microcapsule solution with the organic solvent based scratch-off mixture, the miorocapsule solution is filtered to form a paste-like mixture which will prevent over-dilution of the scratch-off solution.

Another method for producing fragranced game pieces is to incorporate free oil into the scratch-off material or some other part of the game piece. This method does not use microcapsules. It would not have the stability and shelf life of a microcapsule product. The game piece would have an odor which would release naturally and diminish with time and could be used for articles which have a short life span from manufacturing to distribution to the consumer.

The formulation, for dry capsules or paste mixture in solvent scratch-offs is 5–40 percent capsules and 60–95 percent scratch-off (solvent based). The formulation for capsule slurry in aqueous scratch-off is for a 20 percent capsule slurry is a 10–50 percent concentration and a 50–90 percent scratch-off concentration (aqueous). For a free oil in solvent scratch-off, the formulation would include 1–20 percent fragrance oil, 0–10 percent emulsifier and 70–99 percent scratch-off (solvent).

While this invention has been described as having a preferred embodiment, it is understood that it is capable of further modification, uses and/or adaptations of the invention which follow in general the principle of the invention and including such departures from the present disclosure as come within known or customary practice in the art to which the invention pertains, and as may be applied to the central features herein before set forth, and fall within the scope of the invention and the limits of the appended claims.

What is claimed is:

1. A game card for use in a game of chance, comprising:

(a) a support substrate of printed sheet material;
(b) said support substrate includes a face and a back;
(c) said support substrate has indicia printed on at least said face;
(d) said face includes at least a first area and a second area and, said indicia being printed over said first area and said second area;
(e) said first area being visible and illustrating a fragrant object;
(f) said second area being initially hidden under at least one removable layer of opaque scratch-off material;
(g) said indicia printed over said second area indicating a prize value;
(h) microscopic rupturable fragrance-containing capsules blended with said removable layer of opaque scratch-off material;
(i) said capsules containing a fragrance normally associated with said fragrant object; and,
(j) said removable layer of opaque scratch-off material and of microscopic rupturable fragrance-containing capsules are mutually destructible to allow simultaneous release of said fragrance and permit discovery of said prize value.

2. A game card for use in a game of chance, comprising:

(a) a support substrate of printed sheet material;
(b) said support substrate includes a face and a back;
(c) said support substrate has indicia printed on at least said face;
(d) said face includes at least a first area and a second area and, said indicia being printed over said first area and said second area;
(e) said first area being visible and illustrating a fragrant object;
(f) said second area being initially hidden under at least one removable layer of opaque scratch-off material;
(g) said indicia printed over said second area indicating a prize value;
(h) a layer of microscopic rupturable fragrance-containing capsules in contact with said removable layer of opaque scratch-off material;
(i) said capsules containing a fragrance normally associated with said fragrant object; and,
(j) said removable layer of opaque scratch-off material and said layer of microscopic rupturable fragrance-containing capsules are mutually destructible to allow simultaneous release of said fragrance and permit discovery of said prize value.

3. The game card of claim 2, wherein:
(a) said scratch-off layer and said capsules are blended and form a single layer.

4. The game card of claim 3, wherein:
(a) said single layer is formed from an organic solvent based mixture of scratch-off material and capsules.

5. The game card of claim 3, wherein:
(a) said single layer is formed from an aqueous based mixture of scratch-off material and capsules.

6. The game card of claim 3, wherein:
(a) said scratch-off layer is a soft polymeric elastomer material.

7. The game card of claim 2, wherein:
(a) said capsules form a layer over said scratch-off material.

8. The game card of claim 2, wherein:
(a) said scratch-off material forms a layer over said capsules.

* * * * *